United States Patent [19]

Lau

[11] Patent Number: 4,938,717

[45] Date of Patent: Jul. 3, 1990

[54] REINFORCED JACK PLUG

[75] Inventor: Frederick L. Lau, Skokie, Ill.

[73] Assignee: Switchcraft, Inc., Chicago, Ill.

[21] Appl. No.: 415,804

[22] Filed: Oct. 2, 1989

[51] Int. Cl.[5] ..... H01R 17/18

[52] U.S. Cl. ..... 439/669

[58] Field of Search ..... 439/668, 669

[56] References Cited

U.S. PATENT DOCUMENTS 3,398,392 8/1968 Henderson ..... 439/668

4,018,501 4/1977 Maloof ..... 439/669

*Primary Examiner*—Joseph H. McGlynn

*Attorney, Agent, or Firm*—William R. Clark; Richard M. Sharkansky

[57] ABSTRACT

An electrical jack of the composite prong type having a leading end portion comprising a tapered tip component of an axially extending tip contact member. The tapered tip component has a proximal end portion terminating in a circular flange which has first diameter and is integrally joined to a rod component of much smaller diameter through a reinforced length component of intermediate diameter. The reinforced length component has a cross sectional size designed for uniformly distributing impact stresses transmitted from the tapered tip component, and has a length greater than its intermediate diameter for minimizing impact stresses transmitted to the rod component. The reinforced length component is slidably installed in a cup-shaped dielectric bushing having a flanged open end portion abutting the circular flange of the tapered tip component. The cup-shaped bushing has an opposing closed end provided with a central aperture through which extends the rod component and an encircling dielectric sheath. An outer sleeve contact member has an end portion provided with an enlarged diameter cavity wherein the dielectric bushing is slidably inserted until the adjacent end of the sleeve contact butts against the flanged open end portion of the bushing. The cavity in the sleeve contact member communicates with a smaller diameter bore through the dielectric sheath and the encircled rod component extend.

2 Claims, 1 Drawing Sheet

REINFORCED JACK PLUG

BACKGROUND OF THE INVENTION

1. Field of the Invention

This invention relates generally to electrical jack connectors and is concerned more particularly with an electrical jack plug having internal means for withstanding impact stresses applied to the tip contact member of the jack plug.

2. Discussion of the Prior Art

An electrical jack plug may be of the composite prong type having a spear-like "tip" contact member with a shaft component insulatingly disposed within a coaxial "sleeve" contact member. The jack plug may have an external surface comprised of a solid tapered tip component of the tip contact member projecting axially from a flat surface of a dielectric washer which has an opposing flat surface abutting one end of the sleeve contact member. The sleeve contact member extends axially from the dielectric washer and has an outer diameter greater than the maximum transverse dimension of the tapered component. Thus, the dielectric washer serves as an insulating spacer for maintaining the sleeve contact member in predetermined axial spaced relationship with the tapered tip component of the tip contact member. Consequently, when the jack plug is slidably inserted into a jack receptacle, the tip and sleeve contact members of the jack plug are positioned axially with respect to one another for electrically engaging respective spring-like contacts in the jack receptacle.

Within the sleeve contact member, the shaft component of spear-like tip contact member is encircled by a tubular sheath of dielectric material which electrically insulates the shaft component from the coaxial sleeve contact member. One end portion of the dielectric sheath is disposed within the aperture of the dielectric washer. The opposing end portion of the sheath with the encircled end portion of the shaft component extends axially out of the adjacent end of the sleeve contact member. In assembly, the shaft component is slidably inserted into the dielectric sheath, and the resulting sheath-encased shaft component is slidably inserted into the sleeve contact member. Thus, the sheath-encased shaft component supports the outer surface of the sleeve contact member in predetermined radial spaced relationship with the outer surface of the tapered component of the tip contact member.

In practice, the jack plug may be attached to an end portion of relatively long cable having respective conductors therein connected electrically to the tip and sleeve contact members of the jack plug. The jack plug may be slidably inserted into a jack receptacle whereby an instrument, such as a guitar, for example, may be connected to an electrical device, such as an audio amplifier, for example. Consequently, the end portion of the cable having the jack plug attached thereto may be bounced in random fashion along a hard floor surface, particularly when the jack plug is removed from the jack receptacle and the cable is being coiled by hand. Later, it may be found that the tip contact member is bent where the tapered tip component is attached to the shaft component of the tip contact member. As a result, the jack plug can no longer be slidably inserted into the jack receptacle and requires replacement.

SUMMARY OF THE INVENTION

These and other disadvantages of the prior art are overcome by this invention providing an electrical jack plug with a tip contact member having a tapered tip component with a proximal end portion attached to an aligned rod component of reduced cross sectional size through a reinforced length component of intermediate cross sectional size. The reinforced length component has a length dimension which is about twice as great as its maximum cross sectional dimension. Consequently, the reinforced length component provides means for spacing the rod component from the tapered tip component a safe distance where bending is not apt to occur as a result of the tapered tip component repeatedly impacting a solid surface. Also, the reinforced length component provides a larger cross section than the cross section of the rod component for rapidly distributing impact stresses transmitted from the tapered tip component.

Moreover, this electrical jack plug includes a cup-like dielectric bushing which slidably receives therein the reinforced length component of the tip contact member. The cup-like bushing has an open end portion provided with an outwardly extending annular flange which abuts the proximal end portion of the tapered tip component of the tip contact member and functions as a dielectric washer. An opposing closed end portion of the cup-like bushing is provided with a central aperture through which the rod component of the tip contact member extends. Protruding into this central aperture in the closed end of the cup-like bushing is an end portion of a tubular dielectric sheath which encircles the rod component of the tip contact member. Thus, the dielectric bushing and the dielectric sheath have overlapping end portions and cooperate to serve as a protective dielectric casing for the reinforced length and rod components of the tip contact member. Also, the dielectric bushing is provided with a wall thickness which is significantly greater than the wall thickness of the dielectric sheath in order to function as a resilient cushion during any lateral movement of the reinforced length component.

This jack plug also includes a sleeve contact member comprising a hollow tube of electrically conductive material which slides over the dielectric sheath and the dielectric bushing encircling the rod and reinforced length components, respectively, of the tip contact member. The sleeve contact member has a leading end portion provided with an inner annular landing which seats on the annular flange extending outwardly from the open end portion of the dielectric bushing. The annular landing encircles one end of an enlarged diameter cavity which slidably receives the dielectric bushing having therein the reinforced length component.

BRIEF DESCRIPTION OF THE DRAWINGS

For a better understanding of this invention, reference is made in the following detailed description to the accompanying drawing wherein.

DESCRIPTION OF THE PREFERRED EMBODIMENT

Figure 1:
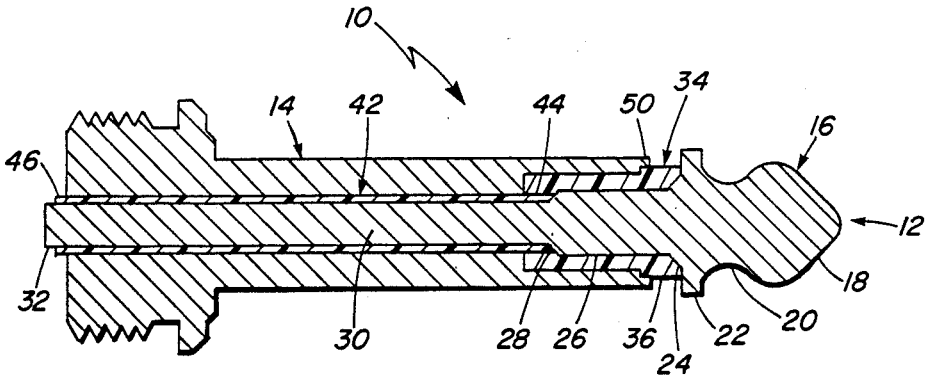
FIG. 1 is a longitudinal view, partly in section, of an electrical jack plug embodying the invention.

Referring to the drawing wherein like characters of reference designate like parts, there is shown in FIG. 1 an electrical jack plug 10 having an elongated cylindrical body comprising an axially disposed tip contact member 12 insulatingly supporting in coaxial relationship an outer sleeve contact member 14. The tip and sleeve contact members 12 and 14, respectively, are made of suitable electrically conductive material, such as a brass alloy material, for example. Tip contact member 12 includes a solid tapered tip component 16 which has an outer surface disposed symmetrically about the axial centerline of jack plug 10 and constitutes the leading end portion of the jack plug. Accordingly, when the jack plug 10 is connected to an end portion of a relatively long cable (not shown) which generally is coiled by hand, it may be readily seen that the leading end portion or tapered tip component 16 of plug 10 is apt to bounce randomly along a hard floor surface and be subjected to impact stresses associated with striking the floor surface sharply numerous times.

Figure 2:
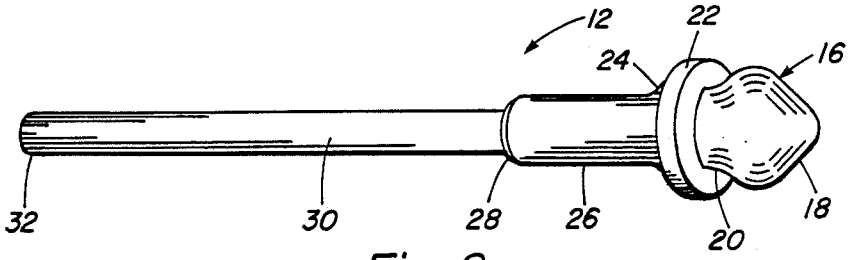
FIG. 2 is an isometric view of the tip contact member shown in FIG. 1.

As shown in FIG. 2, the tapered tip component 16 has a conical distal end portion 18 integrally joined through a smaller diameter neck portion 20 to a circular flange portion 22 which comprises the proximal end portion of tapered tip component 16. The circular flange portion 22 has a diameter which is greater than the largest diameter of conical end portion 18 and constitutes the maximum transverse dimension of tapered tip component 16. Flange portion 22 has an opposing flat surface area encircling a collar-like first joint 24 through which the tapered tip component 16 is integrally attached to an adjacent end portion of a reinforced length component 26 of tip contact member 12.

The reinforced length component 26 has a substantially uniform diameter which is less than the diameter of circular flange portion 22. Consequently, the reinforced length component 26 has a cross sectional size which is correspondingly less than the cross sectional size of flange portion 22. Also, the reinforced length component 26 extends axially in alignment with the tapered tip component 16 for a predetermined distance which is greater than the diameter of reinforced length component 26. An opposing end portion of reinforced length component 26 terminates in a bevelled shoulder-like second joint 28 through which the reinforced length component 26 is integrally attached to an adjacent end portion of a rod component 30 of plug 10. Rod component 30 extends axially in alignment with the reinforced length component 26 and has an opposing end portion 32 protruding insulatingly from the adjacent end portion of sleeve contact member 14. The end portion 32 of rod component 30 may be provided with a conventional terminal (not shown) in a well-known manner for connecting the tip contact member 12 to a respective conductor in an electrical cable (not shown).

Rod component 30 has a substantially uniform diameter which is less than the diameter of reinforced length component 26 and is considerably less than the diameter of circular flange portion 22. In a prior art jack plug of the described type, the rod component 30 generally is attached directly to the flange portion 22 thereby forming a junction where an abrupt change in cross sectional size occurs. It has been theorized that the abrupt change in cross sectional size causes a high concentration of stresses at the junction where bending of the rod component 30 occurs when the tapered tip component 16 is struck repeatedly against a hard surface. Consequently, in the practice of this invention, the reinforced length component 26 is disposed between the flange portion 22 and the rod component 30 to provide a more gradual change in cross sectional size. As a result, the stress lines are distributed more uniformly at the first and second junctions 24 and 28, respectively, thereby enabling the jack plug 10 to withstand the stresses induced when the tapered tip component 16 is struck repeatedly against a hard surface.

Accordingly, it is recommended that the diameter of reinforced length component 26 be about one and one-half times the diameter of rod component 32, and the length of reinforced length component 26 be about two and one-half times the diameter of rod component 32. As a result, the reinforced length component 26 will have a sufficient cross section adjacent the first junction 24 for uniformly distributing impact stresses transmitted from the tapered tip component 16. Also, the reinforced length component 26 will have a length sufficient for dissipating most of the impact stresses transmitted through the first junction 24 and for minimizing the impact stresses transmitted through the second junction 26 to the rod component 32. Thus, it may be seen that the reinforced length component 26 functions as a protective means for spacing the rod component 30 a safe distance from the tapered tip component 16 and for absorbing impact stresses transmitted from the tapered tip component 16.

Figure 3B:
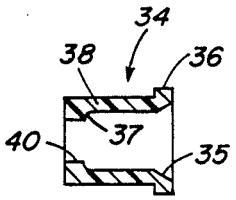
FIG. 3B is an axial sectional view taken along the line 3B—3B shown in FIG. 3A and looking in the direction of the arrows.
Figure 3A:
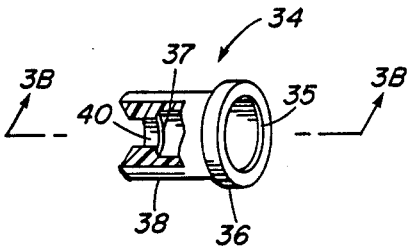
FIG. 3A is an isometric view, partly in section, of the dielectric bushing shown in FIG. 1.

As shown in FIGS. 1 and 3A—3B, the reinforced length component 32 is slidably installed in a cup-shaped bushing 34 made of resilient dielectric material, such as a thermoplastic material, for example. Bushing 34 has an open end provided with an inner peripheral surface 35 which is chamfered for receiving the collar-like first joint 24 of tip contact member 12. Extending radially outward from the open end portion of bushing 24 is an integral annular flange 36 which has a flat surface abutting the flat surface area of flange portion 22 encircling the first joint 24. An axially extending wall portion 38 of bushing 34 slidably engages the outer surface of reinforced length component 30 and terminates in a closed end of cup-shaped bushing 34. The closed end of bushing 34 has an inner surface 37 which is bevelled with respect to the axial centerline of bushing 34 for accommodating the shoulder-like second joint 38. Thus, in assembly, the rod component 30 is fed through the aperture 40 in the closed end of bushing 34; and the reinforced length component 26 is inserted slidably into the cup-shaped bushing 34 until the flange 36 thereof butts against the flange portion 22 of tip contact member 12. As a result, the second joint 28 is disposed adjacent the conformingly bevelled surface 37; and the adjoining end portion of rod component 32 is disposed axially in the aperture 40.

Figure 4:
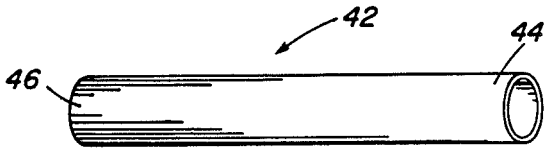
FIG. 4 is an isometric view of the dielectric sheath shown in FIG. 1.

As shown in FIGS. 1 and 4, there is slidably disposed over the rod component 32 an encircling sheath 42 made of resilient dielectric material, such as a thermoplastic material, for example. Adjacent the second joint 28, the sheath 42 has an end portion 44 which is slidably received in the aperture 40 whereby the end portion 44 of dielectric sheath 42 is overlapped by the closed end portion of dielectric bushing 34. Thus, the sheath 42 comprises an axially extending tubular wall having an inner diameter which is slightly larger than the diameter of rod component 26, and having an outer diameter which is slightly smaller than the diameter of aperture 40.

It should be noted that the dielectric bushing 34 has a wall thickness which is about twice the wall thickness of dielectric sheath 42 in order to provide means for cushioning lateral movements of the reinforced length component 26 when the tapered tip component 16 is subjected to impact stresses. An opposing end portion 46 of the sheath 42 enables the rod component 30 to extend insulatingly out of the sleeve contact member 14. Also, the sheath 42 has a length which is slightly less than the length of rod component 30 whereby the end portion 32 of rod component 30 protrudes from the adjacent end portion 46 of dielectric sheath 42. Thus, the end portion 32 of rod component 30 is disposed for electrical connection to a well-known terminal means (not shown) for electrically connecting the tip contact member 12 to a respective conductor of an attached electrical cable (not shown).

Figure 5:
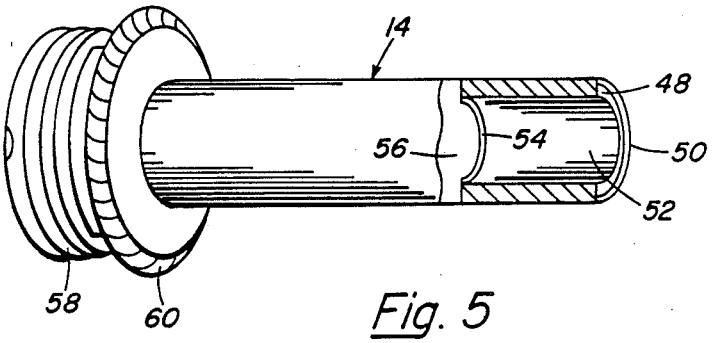
FIG. 5 is an isometric view, partly in section, of the sleeve contact member shown in FIG. 1.

As shown in FIGS. 1 and 5, the sleeve contact member 14 comprises a hollow cylindrical conductor having adjacent the flange 30 of bushing 34 an end surface with an inner peripheral portion wherein a shallow inset landing 48 is disposed. The sleeve contact member 14 has disposed about the landing 48 an axially extending end portion 50 which has an inner diameter greater than the outer diameter of flange 36. In assembly, the flange 36 of bushing 34 is received within the end portion 50 of sleeve contact member 14 and seats against the landing 48. Accordingly, the flange 36 is provided with a thickness greater than the axial extent of end portion 50 measured from the landing 48 to ensure that the end portion 50 encircling flange 36 does not contact the flange portion 22 of tapered tip component 16. Thus, the flange 36 of bushing 34 provides means for electrically insulating the end portion 50 from flange portion 22 and for spacing the sleeve contact member 14 a predetermined distance from the tapered tip component 16 of the tip contact member 12. As a result, the external surface of jack plug 10 is similar to the external surface of prior art jack plugs. Consequently, the jack plug 10 may be slidably inserted into a convental jack receptacle (not shown) in a well-known manner for the tip contact member 12 and sleeve contact member 14 to engage respective electrical contacts therein.

Annular landing 48 encircles one end of an enlarged diameter cavity 52 having an axially extending wall surface which slidably engages the axially extending wall 38 of dielectric bushing 34. Consequently, the cavity 52 has a diameter which is only slightly larger than the outer diameter of axially extending wall 38. Cavity 52 terminates at an inner annular shoulder 54 which is disposed adjacent the closed end of cup-shaped bushing 34. The shoulder 54 is formed where the larger diameter cavity 52 communicates with an axially aligned bore 56 of sleeve contact member 14 having a smaller diameter. Bore 56 extends axially from the annular shoulder 54 to the opposing end of sleeve contact member 14. Slidably disposed in the bore 56 is the dielectric sheath 42 encircling the rod component 30 of tip contact member 12.

Thus, the dielectric sheath 42 and the dielectric bushing 34 electrically insulate the tip contact member 12 from the sleeve contact member 14. Furthermore, the reinforced length and rod components 26 and 34, respectively, encased in the dielectric bushing 34 and the dielectric sheath 42 support the outer surface of sleeve contact member 14 in predetermined radial relationship with the axial centerline of tip contact member 12. Sleeve contact member 14 has an opposing end portion 58 which may be connected to well-known terminal means (not shown) for connecting the sleeve contact member 14 to an electrical conductor of an attached electrical cable. Also, the end portion 58 of sleeve contact member 14 may have external threads terminating in a knurled flange 60 for engaging an end portion of a tubular handle (not shown) which protectively encircles the terminal means (not shown) connected to the tip contact member 12 and the sleeve contact member 14.

Accordingly, there has been disclosed herein a jack plug 10 including an axially disposed tip contact member 12 having tapered tip component 16 with a maximum cross sectional size and rod component 30 with a smaller cross sectional size spaced apart by a reinforced length component 26 with an intermediate cross sectional size. The cross sectional size of the reinforced length component 26 is designed for distributing uniformly impact stresses transmitted from the tapered tip component 16. The length of the reinforced length component is designed to be greater than a maximum transverse dimension thereof for spacing the rod component 30 from the tapered tip component 16 a safe distance wherein most of the impact stresses transmitted from the tapered tip component 16 may be dissipated.

Moreover, the jack plug 10 includes dielectric bushing 34 having a cup-shaped structure axially aligned with dielectric sheath 42 for slidably receiving the reinforced length component. The bushing 34 has a wall thickness twice as great as the wall thickness of the sheath 42 for cushioning lateral movements of the reinforced length component when impact stresses are applied to the tapered tip component. Furthermore, the jack plug 10 includes outer sleeve contact 14 having a leading end portion 50 provided with an internal cavity 52 for slidably receiving therein the dielectric bushing 34 encircling the reinforced length component 26. The leading end portion 50 of sleeve contact member 14 is axially spaced from the flange portion 22 of tapered tip component 16 by interposed dielectric flange 36 of bushing 34. Thus, the jack plug 10 is provided with an external surface similar to the external surfaces of prior art jack plugs. Consequently, the jack plug 10 may be slidably inserted into a conventional jack receptacle wherein the axially spaced tapered tip component 16 and the sleeve contact member 14 may electrically engage respective spring contact members in a well-known manner.

From the foregoing, it will be apparent that all of the objectives have been achieved by the structures and methods described herein. It also will be apparent, however, that various changes may be made by those skilled in the art without departing from the spirit of the invention, as expressed in the appended claims. It is to be understood, therefore, that all matter shown and described is to be interpreted as illustrative and not in a limiting sense.

What is claimed is:

1. An electrical jack plug comprising:

elongated cylindrical body means having a leading end and an opposing trailing end, said body means comprising a tip contact member made of electrically conductive material and extended axially of said body means, said tip contact member being provided with a tip component having a distal portion disposed adjacent said leading end of said body means and having a first maximum transverse dimension;

said body means further comprising a reinforced length component connected in axial alignment with said tip component and having a second maximum transverse dimension smaller than said first maximum transverse dimension;

said body means further comprising a rod component connected in axial alignment with said reinforced length component and having a third maximum transverse dimension smaller than said second maximum transverse dimension;

said reinforced length component having a length dimension greater than said second maximum transverse dimension and having a cross sectional size means for uniformly distributing impact stresses applied to said tip component and transmitted to said reinforced length component;

said tip component having a symmetrical outer surface tapering convergently toward said leading end of said body, said first maximum transverse dimension comprising the transverse dimension of a proximal portion of said tip component adjacent said reinforced length component;

said reinforced length component comprising a cylindrical structure having one end portion integrally attached through a first joint to said proximal portion of said tip component and having a substantially uniform diameter smaller than said transverse dimension of said proximal portion, said cylindrical structure having an opposing end portion integrally attached through a second joint to said rod component;

said body means including a cup-shaped bushing made of dielectric material and having an axially extending wall slidably encircling said reinforced length component, said cup-shaped bushing having an open end disposed adjacent said proximal portion of said tip component and having an opposing closed end provided with a central aperture through which extends said rod component; and said body means including a tubular sheath made of dielectric material and slidably encircling said rod component, said tubular sheath having an end portion protruding into said closed end of said bushing.

2. An electrical jack plug as set forth in claim 1 wherein said body means includes an outer sleeve contact member made of electrically conductive material and disposed in encircling relationship about said dielectric bushing and dielectrical sheath, said contact sleeve having an end portion disposed in insulating spaced relationship with said proximal portion of said tip component and provided with an inner enlarged diameter cavity means for receiving therein said dielectric bushing.

* * * * *